United States Patent [19]

Ridgway

[11] 4,300,353

[45] Nov. 17, 1981

[54] VEHICLE PROPULSION SYSTEM

[76] Inventor: Stuart L. Ridgway, 537 Ninth St., Santa Monica, Calif. 90402

[21] Appl. No.: 803,869

[22] Filed: Jun. 6, 1977

Related U.S. Application Data

[63] Continuation of Ser. No. 598,888, Jul. 24, 1975, abandoned.

[51] Int. Cl.[3] ..... F01K 23/06

[52] U.S. Cl. ..... 60/618

[58] Field of Search ..... 60/615, 616, 619, 624, 60/618

[56] References Cited

U.S. PATENT DOCUMENTS

| | | | |
|---|---|---|---|
| 982,850 | 1/1911 | Noyes | 60/618 X |
| 1,230,617 | 6/1917 | Still | 60/618 |
| 1,297,263 | 3/1919 | Simms | 60/618 |
| 1,315,505 | 9/1919 | Jackman | 60/615 |
| 1,339,177 | 5/1920 | Dyer | 60/618 |
| 2,737,014 | 3/1956 | Bush | 60/618 |
| 3,877,229 | 4/1975 | Resler, Jr. | 60/616 X |
| 4,031,705 | 6/1977 | Berg | 60/615 |

*Primary Examiner*—Allen M. Ostrager
*Attorney, Agent, or Firm*—Fulwider, Patton, Rieber, Lee & Utecht

[57] ABSTRACT

A hybrid vehicle propulsion system is disclosed which utilizes an internal combustion engine, an afterburner, and a steam engine in combination for improved efficiency and reduced emission of pollutants. The afterburner is provided to reduce the level of pollutants emitted and to increase the temperature of the exhaust gases from the internal combustion engine. The heat from the exhaust gases, together with the heat removed from the internal combustion cylinders, is then utilized in the steam engine to provide additional propulsion.

29 Claims, 4 Drawing Figures

VEHICLE PROPULSION SYSTEM

This is a continuation of application Ser. No. 598,888, filed July 24, 1975, now abandoned.

BACKGROUND OF THE INVENTION

1. Field of the Invention

This invention relates to vehicle propulsion systems, and more particularly to such systems which are directed to the reduction of polluting emissions and/or improved efficiency in operation. This invention further relates to hybrid systems which combine internal combustion (I.C.) engines and other propulsion means to maximize efficiency in operation and fuel economy while providing minimized emission of pollutants.

2. Description of the Prior Art

As is well known, the conventional spark-ignited, internal combustion engine has dominated personal transportation today for the average American. The engine is inexpensive, is reasonably efficient, and is available with high power in reasonable sizes and weights. The details of its design and its place in the national economy evolved during a period of great availability of inexpensive petroleum-derived fuel. As America's rate of new oil discovery faltered, there seemed to be unlimited supplies of cheap oil flowing from the sands of the Middle East. In the period of generous oil supplies, the main criticism of the internal combustion engine was directed at its emissions of unburned hydrocarbons and oxides of nitrogen that react when exposed to sunlight to make the photochemical smog that Los Angeles had made famous and of carbon monoxide, which is a poison. As the automobile industry has struggled to bring the emissions under control, it has found and advertised, that good fuel economy and low emissions are competing demands, that some of one must be given up in order to get more of the other.

Increased efforts have been directed toward improving the efficiency of various types of power sources by combining different types of prime movers in a single power system. Examples of such combinations may be found in U.S. Pat. Nos. 2,581,596 of Nims, 2,416,942 of Newcomer, and 3,691,760 of Vidal et al; and British Pat. No. 644,759. However, insofar as is known, neither these examples nor any other design efforts have been directed particulary to the problem of combining a steam engine with a piston-type internal combustion engine in a system which effectively improves the overall efficiency by permitting the use of a substantially lower-powered engine with improved fuel economy, and at the same time substantially reducing or eliminating the polluting emissions commonly encountered in the exhaust from the internal combustion engine.

At the present time, I.C. engines are efficient in a range from approximately $\frac{1}{4}$ to $\frac{3}{4}$ of full load. Even within this limited range, high fuel economy is inconsistent with low levels of emission of pollutants. Low-end torque is not easily available from I.C. engines and is usually provided by complicated and inefficient mechanical transmissions.

The efficiency of the internal combustion engine falls off significantly at loads less than a quarter of full load, and dramatically for loads below a tenth full load. To provide the ten horsepower needed for forty miles an hour cruise from a 200 horsepower engine at high fuel economy is quite inefficient. One could choose to use a smaller I.C. engine, but at the sacrifice of acceleration performance. Most drivers rarely use the full power of their engines, but they really wish to have it available.

Steam engines, on the other hand, provide good low-end torque without complicated mechanical transmissions, and also can be easily used to provide overload power at some sacrifice in efficiency by lengthening the steam admission time during the expansion stroke. In addition, steam engines, because they are external combustion devices, run efficiently at low emission pollutant levels. Steam engines, however, require boilers and condensers of significant capacity and for this reason have been comparatively unsatisfactory for vehicular use.

The difficulties described above with respect to both internal combustion and steam engines are especially disadvantageous in vehicle propulsion systems which require fast start-up and good acceleration characteristics over a broad and continuously varying range of loads, as opposed to a static power plant run at fixed rpm and fairly constant load conditions.

SUMMARY OF THE INVENTION

The instant invention provides a hybrid internal combustion and steam engine system yielding good fuel economy over the load and rpm ranges encountered in vehicle propulsion systems, while minimizing pollutant emissions. These usually mutually-exclusive goals of high efficiency and low pollution cannot be obtained by conventional non-hybrid systems.

The hybrid propulsion system according to the instant invention provides, in general, for the conversion of the heat energy lost in the internal combustion cylinders to mechanical energy by use of a Rankine cycle engine such as a steam engine. The steam engine operates both on the heat content of the cooling fluid in the conventional cooling system used to remove a portion of the heat of combustion from the internal combustion cylinder chambers and also on the heat content of the internal combustion engine exhaust gases.

The internal combustion engine of the system of this invention is operated at an air-fuel mixture providing minimized unburnable pollutants ($NO_x$), and an afterburner is provided to recover the chemical energy in the exhaust gases while eliminating substantially all the combustible pollutants. The afterburner serves as a second heat source to increase the temperature of the internal combustion engine exhaust gases. These gases are then directed to a steam generator where they are used to boil and to superheat the already-heated cooling fluid in a high-pressure boiler for subsequent use in a high-pressure expander to develop mechanical power.

The fluid discharge from the high-pressure expander is combined with the vapor formed in the cooling system and reheated by heat exchange with the exhaust gases. These combined fluids are then used to operate a lower-pressure expander to develop additional propulsion. The discharge from the lower-pressure expander is returned to a condenser similar to a conventional radiator for condensation before return to the cooling jackets surrounding the engine cylinders, and to the steam generator unit (boiler) in the exhaust gas stream.

BRIEF DESCRIPTION OF THE DRAWING

A better understanding of the present invention may be had from a consideration of the following detailed description, taken in conjunction with the accompanying drawing, in which.

DESCRIPTION OF THE PREFERRED EMBODIMENT

Figure 1:
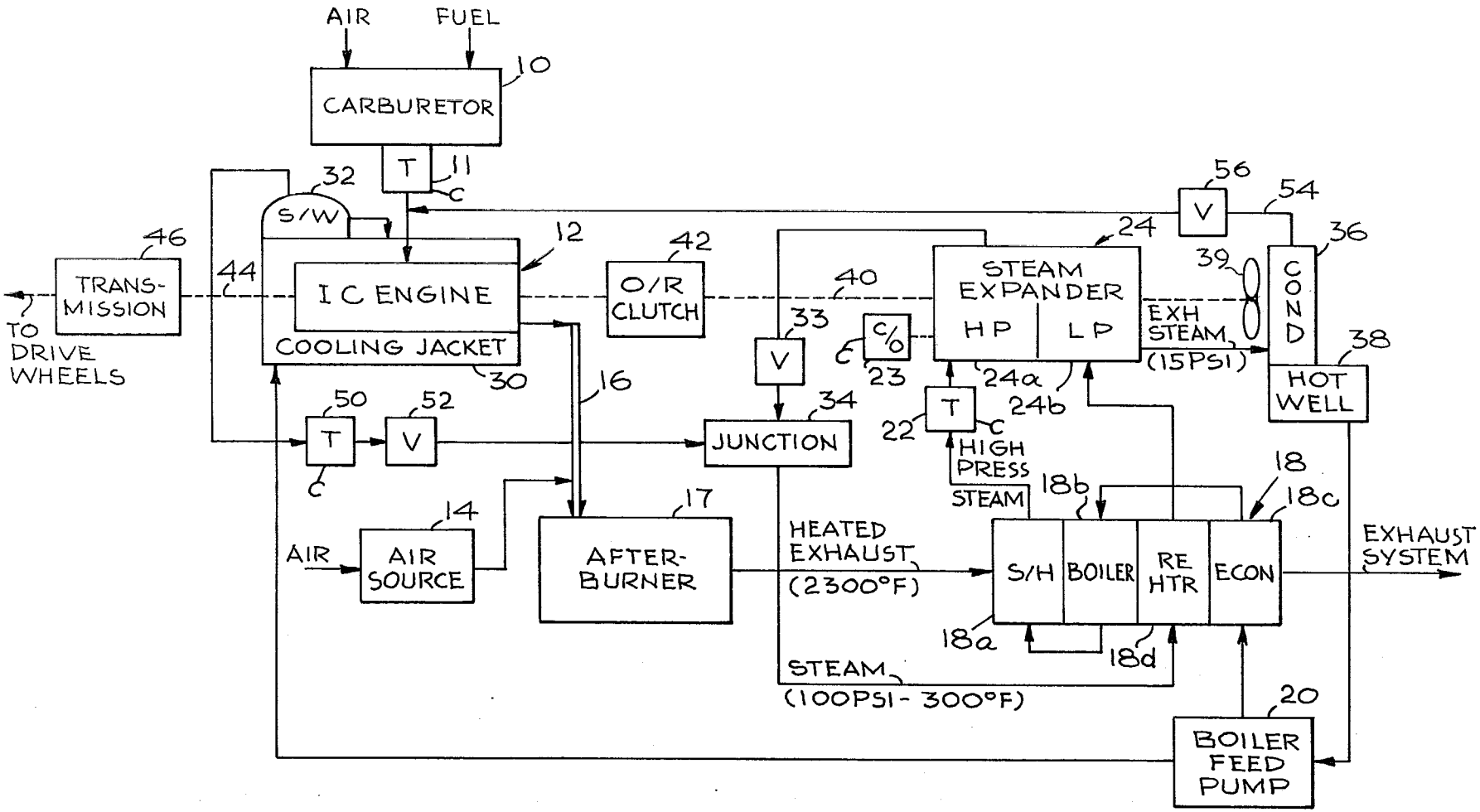
FIG. 1 is a combination block and schematic diagram illustrating the particulars of the present invention.

A preferred embodiment of the invention is shown schematically in block diagram form in FIG. 1. Air and fuel are supplied to conventional carburetor 10 having a throttle 11, and a mixture is applied to the I.C. engine 12. The mixture provided by the carburetor 10 is purposely made richer than stoichiometric, in a range of fuel-air ratios between 0.075 and 0.120, preferably about 0.090. The exhaust gas from the I.C. engine, which under moderate to heavy loads will be at a temperature in the range of 1000° F. to 1350° F. and for a fuel-air ratio of 0.090 input to the engine will contain about 3.5% hydrogen and 8% carbon monoxide, is mixed with air from air source 14 (which may typically be a blower driven as an accessory) in either exhaust pipe 16 or afterburner 17 and the combustible mixture burned in afterburner 17. This combination releases sufficient heat to raise the exhaust gas temperature to approximately 2300° F.

The exhaust gas from the internal combustion engine is sufficiently rich in combustibles that when mixed with sufficient air a combustion reaction can be initiated by a spark, and maintained by suitable combustion chamber design. Back mixing of hot burnt exhaust into the fresh air mixture by well known methods such as flameholders, opposing jets, or other methods of providing recirculation is an effective and suitable method of burning this exhaust. These considerations are expounded more fully in paper No. 290, "Homogeneous Reaction Kinetics and the Afterburner Problem," presented by the inventor at the SAE Annual Meeting, Jan. 12–16, 1959. The air may be introduced into the exhaust gas any time after the expansive stroke in the I.C. engine cylinder has been essentially completed, e.g., as extra scavenging air in a two-stroke engine, from ports opened by exhaust valve opening in a four-stroke engine, in the piping between the cylinder and the afterburner, or in the afterburner itself. A conventional spark plug fired by the I.C. engine ignition system is placed in a low velocity region of the flow for initial ignition of the exhaust gas-air mixture. It is useful to provide a region of unrecirculated flow after the main combustion has taken place to finish off the combustion. Normally the transition from the afterburner to the associated steam generator unit 18 will provide this. A combustion chamber volume of between 100 and 200 cubic inches is a suitable size for the afterburner. The burnt exhaust gas is conducted to steam generator unit 18, which preferably consists of approximately 150 feet of steel tubing approximately $\frac{1}{2}$ inches inside diameter and $\frac{3}{8}$ inches outside diameter within a suitable casing.

A convenient arrangement of the steel tubing is to wind two adjacent coils of approximately ten layers, the coils having an inside diameter of about 3 inches and an outside diameter of 10 inches, with a length of 5 inches for each coil. Exhaust gas is introduced into the space at the center of the first coil, flows radially outward over the steel tubing, emerges from the first coil and is then ducted and directed radially inward through the second coil. It emerges in the center of the second coil substantially cooled by virtue of the transfer of its heat energy to the fluid flowing within the steel tubing and is ready for discharge to the atmosphere. Water from a boiler feed pump 20 is introduced into the tubing at the center of the second coil, flows spirally outward through the second coil and then spirally inward through the first coil until it is discharged as steam to a throttle valve 22.

The exhaust gas is cooled to about 500° F. in the process of transferring its heat to the water in steam generator unit 18. The water and the exhaust gas are preferably in substantially counter-current flow heat transfer relationship within the steam generator unit 18. Suitable operating conditions for the steam generator unit 18 are to introduce the feed water at 1500 psi and 180° F. from the boiler feed pump 20, and for the generator 18 to produce 900° F. superheated steam. The steam generator unit 18 may be conceptually divided into four sections, which are the superheater **18*a*, the boiler 18*b*, the feedwater heater or economizer 18*c*, and the optional reheater 18*d*. Normally the second coil is the economizer 18*c*, and the first coil serves the function of boiler 18*b* and superheated 18*a*. The optional reheater 18*d*** is composed of additional tubing inserted into the ducting between the first coil and the second coil, or may be integrated into the casing.

The feedwater first enters the economizer **18*c* where it is heated to the boiling temperature, which for a pressure of 1500 psi is 650° F. The heated water passes into the boiler section 18*b* where the transferred heat converts the water into steam. The steam leaves the boiler and proceeds to the superheater 18*a* where additional heat is added to superheat the steam. Practical designs of steam generator units often utilize the "once through" concept where the water is pumped through a tube or tubes countercurrent to the heat source fluid flow. In such a generator the boundary between feedwater heater and boiler, and between boiler and superheater may vary considerably with operating conditions without material consequence insofar as the operation of the steam generator unit is concerned. The steam generator 18 essentially consists of some relatively small high pressure steel tubing through which the water flows, climbing in temperature until it boils, then turning into steam at constant temperature as it advances further, and eventually after being fully vaporized, climbing further in temperature until delivered from the steam generator unit 18. Steam throttle 22 controls the application of the high pressure steam to a steam expander 24 having high pressure section 24*a* and low pressure section 24*b***.

The internal combustion engine 12 is provided with a water (or comparable liquid) cooling jacket 30 which is arranged to operate substantially above atmospheric pressure. Water is provided to it by a low pressure output connection on the boiler feed pump 20, driven as an accessory, or by a separate boiler feed pump (not shown). Heat loss to the cylinder walls and head of the I.C. engine converts some of the jacket water to steam which is separated from the water in a steam/water separator 32. This steam is merged in a junction element 34 with low pressure steam that is the exhaust from the intermediate pressure cylinder which is the second stage of the high pressure section **24*a* of the expander 24, directed through the reheater section 18*d* of the steam generator unit 18, and expanded in the low pressure cylinders section 24*b* of the expander 24. A throttle valve 50 is provided for controlling the steam supply from the I.C. engine jacket 30 and separator 32 to the low pressure cylinders. A check valve 52 is placed in this line to prevent steam from the intermediate cylinder exhaust back-flowing into the steam/water separator unit 32 and the I.C. engine jacket 30 during warmup of the system. The exhaust from the low pressure cylinders is directed to a condenser 36 and associated hot well 38 where the steam is condensed to water and the heat of condensation rejected to the atmosphere with the assistance of a cooling fan 39**.

Superheated high pressure steam is delivered at pressures such as 1500 psi, and temperatures such as 900° F. to the steam expander 24, where a portion of the heat energy of the steam is converted into work. The steam expansion is preferably conducted in several stages. In one embodiment the steam expander has four cylinders, one high pressure, one intermediate pressure, and two low pressure. Design center steam pressure values for the high pressure cylinder are 1500 psia inlet and 400 psia exhaust; values for the intermediate cylinder are 400 psia inlet and 100 psia exhaust, and for the two low pressure cylinders, 100 psia inlet and 20 psia exhaust.

The mechanical output of the steam expander 24 is delivered through output shaft 40 via over-running clutch 42 to the I.C. engine shaft 44. The combined power of the two engines is delivered to transmission 46 which transmits the power to the drive wheels of the vehicle.

For an intermediate-sized American car of about 3500 lbs. weight, the displacement of the I.C. engine 12 should be chosen in the range of 80 to 100 cubic inches, and the steam expander 24 should have a displacement of about 126 cubic inches. The steam expander displacement is preferably distributed among the cylinders with 6 cubic inches in the high pressure cylinder, 20 cubic inches in the intermediate pressure cylinder, and 50 cubic inches in each of the low pressure cylinders. The four cylinders may be in-line, or have any other suitable mechanical arrangement. Each cylinder is provided with conventional steam inlet exhaust valves, not shown, preferably cam-operated poppet valves similar to those used in automotive practice. Power control is preferably exercised by steam inlet cutoff control 23 on the high pressure cylinder, and throttling via throttle 50 of the steam supply from the steam water separator 32 to the low pressure cylinders which should operate with steam inlet valve cutoff of about 30% of stroke. For turning over the steam engine from a full stop, means may be provided to extend cutoff to 70% of stroke, and small bleeds from the high pressure steam supply arranged so that intermediate pressure and low pressure steam is available at the start. The high pressure steam throttle 22 is also provided to extend the range of power control when the inlet valve cutoff has been reduced to a practical minimum, and to cut off the steam supply to the engine completely when desired. The control of the duration of admission of steam supply to the high pressure cylinder may be accomplished by methods well known to those skilled in the art, such as operating the inlet valve with a three dimensional cam that is geared to the crankshaft, and is translated to give the variously desired angles of admission, as is described in "Description of a Modern Automotive Steam Power Plant" a paper presented by James L. Dooley to the Los Angeles section of the Society of Automotive Engineers, Jan. 22, 1962. Alternatively a series poppet valve arrangement may be used, one controlling admission, and the other cutoff. Steam is admitted to the cylinder only when both valves are open, and the phase between the two valves is obtained by suitable differential rotations of their respective camshafts. This arrangement is discussed in SAE paper No. 750068, "Component Development of Automotive Reciprocating Steam Expanders", by S. Jakuba and J. McGeehan, presented at the Automotive Engineering Congress and Exposition, Detroit, Michigan, Feb. 24–28, 1975.

The normal steam admission duration to the high pressure cylinder under full torque load conditions will be in the range of 20 to 30% of stroke, and for various cruise conditions be in the range of 5% to 20% of stroke. Under surge conditions the admission will be increased to a maximum of about 70%–80% of stroke. The steam consumption and the consequent power of the steam expander 24 is controlled by the coordinated operation of the high pressure throttle 22, the low pressure throttle 50, and the high pressure cylinder inlet valve steam admission cutoff control (not shown). As more power is demanded of the steam engine, the two throttles are opened further, and the steam admission time lengthened. The cranks of the high and the intermediate pressure cylinders of section **24*a* may be disposed at an angle of 180° to each other, in which case the high pressure cylinder exhaust valve can also serve as the intermediate cylinder inlet valve, i.e., a transfer valve. The exhaust steam from the intermediate pressure cylinder is merged in junction element 34 with the steam from the steam/water separator 15 and conducted through the reheater section 18*c* of the steam generator unit 18. Under various low power conditions the exhaust from the intermediate cylinder can be at a lower pressure than the steam supply from the engine jacket, so a check valve 33 is placed between the exhaust of the intermediate pressure cylinder and steam line junction element 34**.

The condenser 36 is about the same size, and may go in the same place as, the standard automobile radiator. The heat transfer requirements are somewhat greater, but not substantially so, than those of the standard automobile radiator. The condenser 36 is preferably constructed of externally finned vertical steel tubes, such as surface CF-8.72 described on page 220 of Kays and London: "Compact Heat Exchangers," (2d ed. McGraw-Hill) for the strength to resist internal pressure, and the geometry to avoid damage when the water freezes. The vertical condenser tubes are connected between headers at the top and bottom, and the sides of the bottom plenum are made sufficiently flexible to accommodate expansion of the accumulated water during freezing. This bottom plenum is made sufficiently large so that it can contain all the water that could accumulate in the condenser during shutdown without the water level rising into the vertical tubes. The bottom plenum of the condenser may serve as the hot well 38, or a separate flexible-walled container may be provided. Water from the hot well 38 is pumped by the boiler feed pump(s) such as 20 to the I.C. engine cooling jacket 30 and to the steam generator unit 18. A vacuum line 54 is connected from the condenser 36 and hot well 38 via check valve 56 to the I.C. engine intake manifold to collect and dispose of the non-condensibles that may accumulate in the steam system due to decomposition of steam cylinder lubricating oil, and in-leakage of air through imperfect seals. The flow is suitably restricted to prevent excessive quantities of steam from being admitted to the I.C. engine. Thus the check valve 56 may be provided with a restricted orifice to permit limited flow in a one-way direction only without disrupting the mixture at the I.C. engine inlet under any operating conditions.

Figure 2:
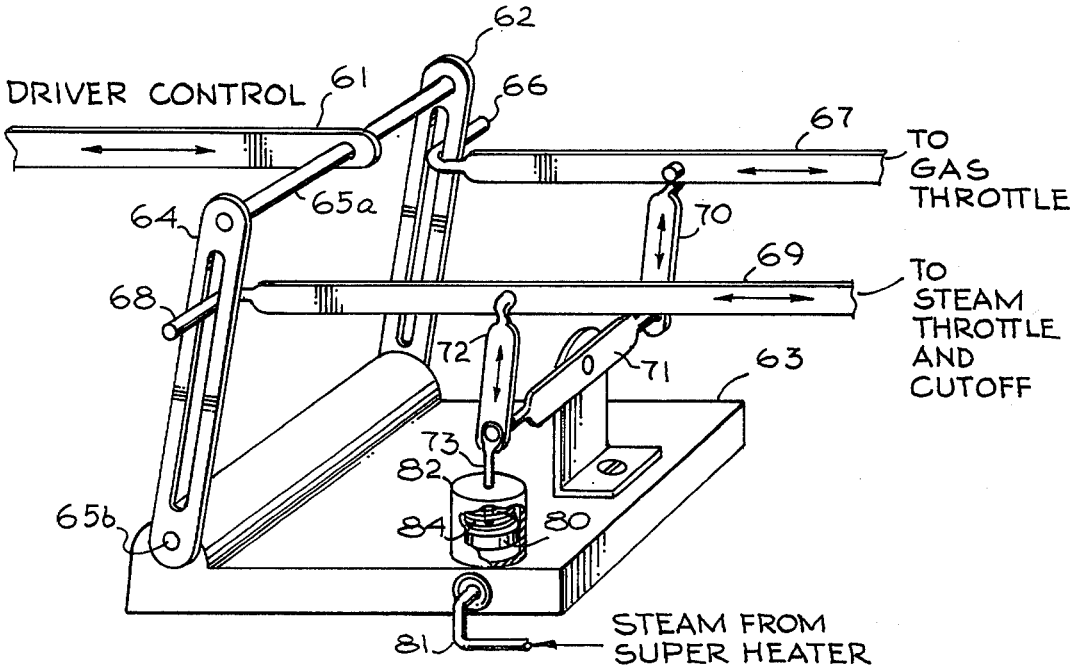
FIG. 2 is a diagram showing the throttle control mechanism for the arrangement of FIG. 1.

Coordinated control of the power of the I.C. engine 12 and the steam expander 24 may be achieved by a control unit 60 such as is illustrated in FIG. 2. In the unit 60 of FIG. 2*a* link rod 61 is connected to the standard foot control pedal that is operated by the driver of the car. Slotted arms 62 and 64 connected together by shafts 65*a*, 65*b* are caused to rotate about the axis of shaft 65*b* mounted in base 63 by the motion of link rod 61. Control rods 67 and 69 connected to the various throttles and cut off control at the points designated "C" in FIG. 1 have pins 66 and 68 riding in the slots in the control arms 62, 64. The linkage consisting of links 70 and 72 joined by link 71 is actuated by rod 73 to control the relative demand made upon the I.C. engine and the steam expander to provide the power called for by the driver's actuation of the power control pedal and consequently the link rod 61. Rod 73 is moved upward with increase of steam pressure in line 81 applied to piston 80 in cylinder 82 against spring 84. This upward motion moves the pin on steam expander power control rod 69 higher in the slot in arm 64, and the pin on I.C. engine throttle control rod 67 lower in the slot in arm 62, with the effect that as the steam pressure increases, the operation of the linkage arranges that more power will be called for from the steam engine, and less from the I.C. engine. Thus, when steam pressure is larger than the desired predetermined value, steam will be drawn from the boiler and cooling jacket at a greater rate, and the I.C. engine will operate at a lower fuel and air throughput to make less exhaust gas, and less heat for the steam generator 18 and engine jacket 30. Accordingly, the two effects cooperate to bring the steam pressure to the desired predetermined value. Similarly if the steam pressure is less than the desired predetermined value, the mechanism will operate in the reverse manner to increase the I.C. engine throughput and exhaust gas flow, and reduce the steam expander steam consumption.

Figure 3:
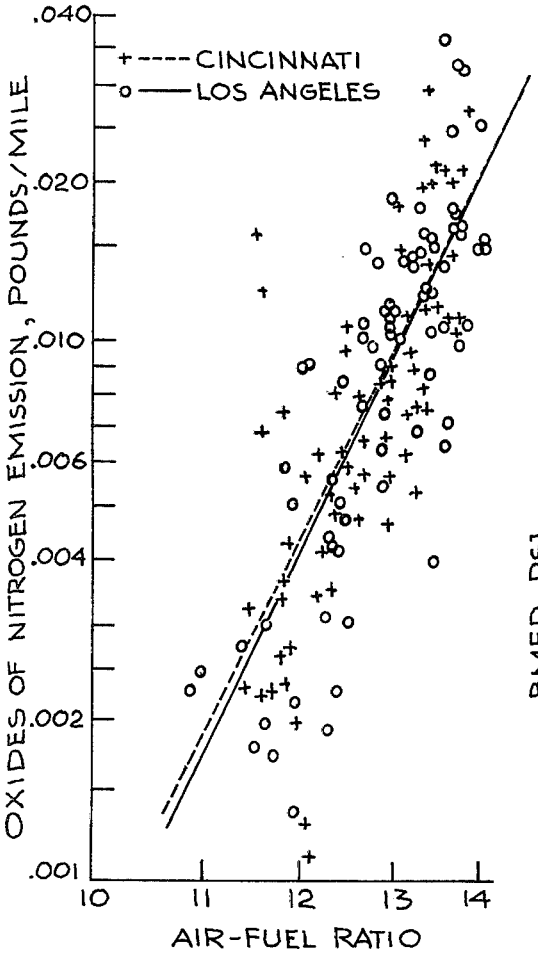
FIG. 3 is a graph showing $NO_x$ production as a function of air-fuel ratio in an automotive engine.

FIG. 3 shows the general trend of oxides of nitrogen production in standard American automobile engines for two different cities, Cincinnati and Los Angeles, as a function of the fuel-air ratio in the mixture fed to the engine. It is apparent from this data that changing the fuel-air ratio of the gasoline-air mixture fed to the internal combustion engine from the standard value of 0.0714 to the preferred value of 0.090 for this invention will effect an overall reduction of $NO_x$ emission from 0.020 lbs./vehicle mile to about 0.0025 lbs./vehicle mile, before crediting the system with the propulsive effort delivered by the steam engine; including this credit demonstrates an overall reduction in oxides of nitrogen emission by a factor of about sixteen.

Figure 4:
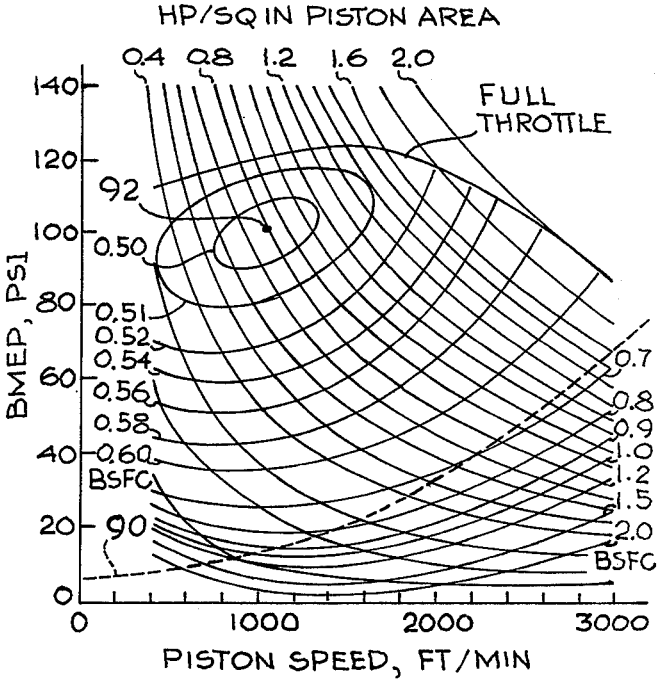
FIG. 4 is a graph showing the performance map of a typical passenger car engine in operation.

FIG. 4 is a graph of a performance map of the conventional I.C. engine installed in an average American car, published in "The Internal Combustion Engine in Theory and Practice," 2nd ed., 1971, by Charles Fayette Taylor, MIT Press, Massachusetts Institute of Technology, Cambridge, Massachusetts. The broken line 90 on the map represents level road load. It is readily apparent that the road load condition is far from the region of best efficiency. The best efficiency is at a brake mean effective pressure (bmep) of about 100 psi, and a piston speed of 1000 ft/min. (approximately the point 92). With a conventional engine in a standard automobile, fifty miles per hour cruise in high gear corresponds to a piston speed of about 1500 ft/minute, and one can see from FIG. 3 that the road load bmep is about 22 psi, and the brake specific fuel consumption (bsfc) is 0.8 lbs/hp-hr. When the conventional engine is replaced with the new engine system of this invention, the I.C. engine of the new engine system under the comparable condition is loaded to a bmep of 44 psi, and its bsfc would be 0.6 lb/hp-hr if it were conventionally carbureted. For the preferred carburetion 1.4 times as much fuel is fed to the I.C. engine for a total fuel consumption of 0.82 lb per I.C. engine horsepower hour. Since the steam engine part of the system provides an amount of power about equal to that provided by the I.C. engine of the system, the overall bsfc of the combined system is half the above value—about 0.42 lb/hp-hr. This is about half the fuel consumption of the conventional I.C. engine.

Overall the new engine is twice as fuel-efficient in automotive service as the conventional powerplant. Furthermore combustible pollutants have been reduced to extremely low values in the afterburner, far below any levels presently set by any air pollution control agency. In addition the $NO_x$ emissions have been reduced by a factor between 10 and 16 below the levels emitted by presently produced engines. This has been done without compromise of fuel economy but instead a dramatic improvement therein has been achieved.

In this preferred application of the engine to the propulsion task, the peak steady state power available from the system is less than that available from the conventional internal combustion engine. However, by taking advantage of the fact that energy storage in the hot water and hot metal of the steam generator unit 18 provides a reservoir from which energy may be drawn for surge power capability, this engine will provide acceleration capability in city traffic, freeway on-ramp acceleration, and passing maneuvers on the open highway. What will be given up in performance in the previously discussed sizing of the engine system to the load is the ability to tow a heavy load up a 10% grade at 60 mph, or to operate the vehicle on the level at speeds above 100 mph. If this performance were necessary in special cases, such as for law enforcement vehicles, the displacement of the I.C. engine and steam engine in the system need only be chosen somewhat larger, at some cost in fuel economy.

The engine system as shown in FIG. 1 of the drawing and described in conjunction therewith is essentially a schematic representation of the preferred embodiment of my invention. Numerous variations may be employed as a matter of design choice. For example, engine accessories such as the pumps, fan, blower and the like may be shaft-driven from the expander or the I.C. engine, or they may be driven by motors from the electrical system. Other arrangements than that shown in FIG. 2 may be employed to coordinate the operation of the steam and gas engine throttles and other controls.

Although there has been described above a specific arrangement of a vehicle propulsion system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed:

1. A vehicle propulsion system which minimizes pollutant emissions but provides good fuel economy over typical vehicle load and speed ranges, said system comprising:

an internal combustion engine, including means for providing the cylinders thereof with a fuel-air mixture in which the fuel-air ratio is substantially greater than the stoichiometric fuel-air ratio, in order to produce a combusted exhaust gas from said internal combustion engine which is low in oxides of nitrogen content and rich in combustibles content, said internal combustion engine having a displacement substantially less than would be necessary for a pure internal combustion engine having a power output equivalent to the power output of said propulsion system, said internal combustion engine further being operated at relatively high cylinder pressures;

means for adding air to the exhaust gas from said internal combustion engine;

combustion means coupled to receive the air and exhaust gas to complete the combustion of the exhaust gas;

a steam generator coupled in heat exchange relationship with the combusted exhaust gas from said combustion means;

a steam expander coupled to receive steam from said steam generator and to thereby generate mechanical power;

means for continuously mechanically coupling said internal combustion engine and said steam expander so that both act together to propel the vehicle under steady-state load requirements; and a first control means to operate said internal combustion engine at a power level substantially less than the steady-state system load power requirements but at a power level nearer that required for maximum fuel efficiency in the internal combustion engine, said steam expander providing the remaining steady-state system load power requirements, whereby the fuel consumption of said system is substantially less than that of the pure internal combustion engine of equivalent power.

2. A vehicle propulsion system as set forth in claim 1, wherein said steam generator has sufficient heat capacity to act as an energy reservoir, and further including a second control means to operate said steam expander at a power level substantially less than the peak power capacity of said steam expander, but sufficient to furnish said remaining steady-state system load power requirements and to operate said steam expander at increased power levels to furnish additional load power for short periods of peak power when rapid acceleration is required, the stored energy being converted to additional mechanical power in said steam expander.

3. A vehicle propulsion system as set forth in claim 1, wherein said exhaust gas combustion means comprises an afterburner.

4. A vehicle propulsion system as set forth in said claim 1, wherein said steam generator comprises a boiler mounted downstream from said combustion means in the exhaust gas stream.

5. A vehicle propulsion system as set forth in claim 4, wherein said steam generator further comprises a superheater connected in series with said boiler and positioned to receive the exhaust gas from said combustion means upstream of said boiler.

6. A vehicle propulsion system as set forth in claim 1, wherein:

said internal combustion engine further includes a water cooling jacket; and said system further includes means for deriving steam from said jacket and applying it to said steam expander.

7. A vehicle propulsion system as set forth in claim 6, wherein said means for deriving steam from said cooling jacket comprises:

means for separating steam from water in said jacket; and means for mixing this steam with steam from said steam generator for application to said steam expander.

8. A vehicle propulsion system as set forth in claim 1, wherein said internal combustion engine includes means for establishing a fuel-air ratio in the range of 0.075 to 0.125.

9. A vehicle propulsion system as set forth in claim 8, wherein said means for establishing a fuel-air ratio establishes the ratio at approximately 0.09.

10. A vehicle propulsion system as set forth in claim 1, wherein:

said steam expander comprises a compound unit having a high pressure section and a low pressure section; and said steam generator further includes a boiler connected to supply steam to said high pressure section, and a reheater connected to receive exhausted steam from said high pressure section and to apply it to said low pressure section after reheating.

11. A vehicle propulsion system as set forth in claim 10, wherein said reheater is located to absorb heat from the exhaust gas stream downstream of said steam generator boiler.

12. A vehicle propulsion system as set forth in claim 10, wherein said steam generator further includes an economizer positioned in heat transfer relationship with the exhaust gas downstream of said boiler, for preheating water with heat drawn from the exhaust gas prior to the introduction of the water to said boiler.

13. A vehicle propulsion system as set forth in claim 10, wherein said high pressure section of said steam expander comprises a first stage and a second or intermediate pressure stage, said first stage feeding exhaust steam into said second or intermediate pressure stage.

14. A vehicle propulsion system as set forth in claim 10, wherein said high pressure section of said steam expander comprises a first high pressure cylinder and a second intermediate pressure cylinder, and said low pressure section of the steam expander comprises a pair of low pressure cylinders of approximately equal displacement.

15. A vehicle propulsion system as set forth in claim 14, wherein said high pressure cylinder has a displacement of approximately 6 cubic inches, said intermediate pressure cylinder has a displacement of approximately 20 cubic inches and said low pressure cylinders each have a displacement of approximately 50 cubic inches.

16. A vehicle propulsion system as set forth in claim 2, wherein said first control means comprises power control means for controlling the rate of fuel-air mixture input to said internal combustion engine and said second control means comprises means for controlling the rate of steam input to said steam expander.

17. A vehicle propulsion system as set forth in claim 16, and further comprising means for coordinating the operation of said first and second control means in accordance with the availability of steam from said steam generator.

18. A vehicle propulsion system as set forth in claim 1, wherein said means for mechanically coupling said internal combustion engine and said steam engine includes an over-running clutch coupled between said internal combustion engine and said steam expander.

19. A method for reducing the output of polluting emissions while improving the economy of a vehicle propulsion system having an internal combustion engine in combination with a steam engine, said method comprising the steps of:

selecting a steady-state nominal load value for said propulsion system;

providing an internal combustion engine having a displacement and consequent power output which will require said engine to operate under moderate to heavy load and thus in its range of relatively high fuel efficiency when said propulsion system is driving its nominal steady-state load;

providing a steam engine having a displacement and consequent power output sufficient continuously to provide at least a small proportion of the nominal steady-state load value for said propulsion system;

mixing fuel and air to develop a mixture having a fuel-air ratio substantially greater than stoichiometric for introduction to the internal combustion engine;

operating the internal combustion engine at a power level less than the steady-state load value for said system but under moderate to heavy load conditions to produce substantially higher cylinder pressures and a higher efficiency than a conventional internal combustion engine of equivalent power to the vehicle propulsion system, operated under the same conditions of load and speed and to produce an exhaust rich in combustible content at an elevated temperature;

mixing the exhaust of the internal combustion engine, it is low in oxides of nitrogen content, with air;

completing the combustion of the mixture of exhaust gas and air in an afterburner;

using the heat of the combusted exhaust gas to generate steam in a steam generator;

applying the steam to the steam expander portion of said steam engine to develop mechanical work therefrom; and operating said steam engine in conjunction with said internal combustion engine to produce mechanical power to supplement the power output from said internal combustion engine whereby said propulsion system provides said selected steady-state nominal value.

20. A method as set forth in claim 19, and further including the steps of;

storing heat energy in the steam generator during periods of steady-state operation at average and low power demands; and removing the energy stored in said storing step, during short periods of peak power demand, to provide additional mechanical power from the steam expander.

21. A method as set forth in claim 19, wherein said step of mixing fuel and air comprises mixing the fuel and air in a ratio in the range of 0.075 to 0.125.

22. A method as set forth in claim 21, wherein the fuel and air are mixed in the ratio of approximately 0.09.

23. A method as set forth in claim 19, wherein said step of generating steam from the heat of combusted exhaust gas includes applying the gas to a superheater, a boiler and an economizer in succession, the superheater, boiler and economizer being coupled in series relationship with respect to the flow of an evaporative fluid therethrough.

24. A method as set forth in claim 19, and further comprising the steps of:

generating steam from the heat of the internal combustion engine; and further heating that steam for application to the steam expander.

25. A vehicle propulsion system providing low pollutant emissions while maintaining good fuel economy, said system comprising:

an internal combustion engine having a substantially smaller displacement than a conventional internal combustion engine of equivalent power to said vehicle propulsion system, said internal combustion engine being normally operated at higher cylinder pressures and a higher efficiency than such conventional engine, when subjected to the same load and speed conditions, said internal combustion engine including means for establishing a fuel-air ratio substantially greater than the stoichiometric ratio, in order to produce an exhaust gas which is low in oxides of nitrogen content and rich in combustibles content;

means for adding air to the exhaust gas from said internal combustion engine;

combustion means coupled to receive air and exhaust gas to complete combustion of the exhaust gas;

a steam engine, including a steam generator coupled in heat exchange relationship with the combusted exhaust gas from said combustion means, and a steam expander coupled to receive steam from said steam generator and to generate mechanical power therefrom, said steam engine being operable to provide sufficient steady-state power to supplement said internal combustion engine adequately for most vehicle operating conditions, and said steam generator having sufficient heat capacity to act as an energy storage reservoir which may be drawn upon for short periods of vehicle acceleration;

means for mechanically coupling said internal combustion engine and said steam engine to propel the vehicle;

first and second power control means for controlling the fuel-air mixture input to said internal combustion engine and the steam input to said steam expander, respectively; and means for coordinating the operation of said power control means in accordance with the availability of steam from said steam generator, said coordinating means having a linkage mechanism for driving said first and second power control means in unison in response to operator control input while adjusting the operation of one power control means relative to the other in accordance with the availability of steam from said steam generator.

26. A vehicle propulsion system as set forth in claim 25, wherein said coordinating means further includes means responsive to steam generator pressure for adjusting the relative control of said first and second power means in response to operator input.

27. A vehicle propulsion system providing low pollutant emissions while maintaining good fuel economy, said system comprising:

an internal combustion engine having a substantially smaller displacement than a conventional internal combustion engine of equivalent power to said vehicle propulsion system, said internal combustion engine being normally operated at higher cylinder pressures and a higher efficiency than such conventional engine, when subjected to the same load and speed conditions, said internal combustion engine including means for establishing a fuel-air ratio substantially greater than the stoichiometric ratio, in order to produce an exhaust gas which is low in oxides of nitrogen content and rich in combustibles content;

means for adding air to the exhaust gas from said internal combustion engine;

combustion means coupled to receive air and exhaust gas to complete combustion of the exhaust gas;

a steam engine, including a steam generator coupled in heat exchange relationship with the combusted exhaust gas from said combustion means, and a steam expander coupled to receive steam from said steam generator and to generate mechanical power therefrom, said steam engine being operable to provide sufficient steady-state power to supplement said internal combustion engine adequately for most vehicle operating conditions, and said steam generator having sufficient heat capacity to act as an energy storage reservoir which may be drawn upon for short periods of vehicle accleration; and means for mechanically coupling said internal combustion engine and said steam engine to propel the vehicle;

and wherein said steam engine further includes a condenser coupled to receive exhaust steam from said steam expander, and means for removing non-condensible products from said condenser and directing them to the input of said internal combustion engine for combustion therein.

28. A vehicle propulsion system as set forth in claim 27, wherein said means for removing non-condensible products comprises a check valve having a restricted orifice for passing the non-condensible products from said condenser to said internal combustion engine input without disrupting the operation of said internal combustion engine.

29. A vehicle propulsion system as set forth in claim 1, wherein:

the vehicle in which said system is installed has a total weight of approximately 3,500–4,000 lb.;

said internal combustion engine has a displacement of approximately 80–100 cubic inches, whereby said internal combustion engine will be operated at relatively high cylinder pressures and at a relatively high efficiency for most driving conditions;

said steam expander has a displacement of approximately 100–130 cubic inches, whereby said steam expander supplies approximately the same mechanical steady-state power as said internal combustion engine, thereby substantially reducing the overall fuel consumption of the vehicle.

* * * * *

UNITED STATES PATENT AND TRADEMARK OFFICE

CERTIFICATE OF CORRECTION

PATENT NO. : 4,300,353

DATED : Nov. 17, 1981

INVENTOR(S) : Ridgway, Stuart L.

It is certified that error appears in the above-identified patent and that said Letters Patent are hereby corrected as shown below:

Column 3, line 15, "applied" should be -- supplied --;

line 27, "combination" should be -- combustion --;

line 60, "½" should be -- ¼ --.

Column 4, line 24, "superheated" should be -- superheater --.

Column 7, line 8, "2a" should be -- 2, a --.

IN THE CLAIMS:

AMEND claim 2 as follows:

--2. A vehicle propulsion system as set forth in claim 1, wherein said steam generator has sufficient heat capacity to act as an energy reservoir[, and further including

UNITED STATES PATENT AND TRADEMARK OFFICE

CERTIFICATE OF CORRECTION

PATENT NO. : 4,300,353

DATED : Nov. 17, 1981

INVENTOR(S) : Ridgway, Stuart L.

It is certified that error appears in the above-identified patent and that said Letters Patent are hereby corrected as shown below:

a second control means to operate said steam expander at a power level substantially less than the peak power capacity of said steam expander, but sufficient to furnish said remaining steady-state system load power requirements and to operate said steam expander at increased power levels to furnish additional load power] which may be drawn upon for short periods of peak power when rapid acceleration is required, the stored energy being converted to additional mechanical power in said steam expander.--

INSERT Claim 10 as follows:

--10. A vehicle propulsion system providing low pollutant emissions while maintaining good fuel economy, said system comprising:

an internal combustion engine having a substantially smaller displacement than a conventional internal combustion It is certified that error appears in the above-identified patent and that said Letters Patent are hereby corrected as shown below:

engine of equivalent power to said vehicle propulsion system, said internal combustion engine being normally operated at higher cylinder pressures and a higher efficiency than such conventional engine, when subjected to the same load and speed conditions, said internal combustion engine including means for establishing a fuel-air ratio substantially greater than the stoichiometric ratio, in order to produce an exhaust gas which is low in oxides of nitrogen content and rich in combustibles content;

means for adding air to the exhaust gas from said internal combustion engine;

combustion means coupled to receive air and exhaust gas to complete combustion of the exhaust gas;

a steam engine, including a steam generator coupled in heat exchange relationship with the combusted exhaust gas from said combustion means, and a steam expander coupled to

UNITED STATES PATENT AND TRADEMARK OFFICE

CERTIFICATE OF CORRECTION

PATENT NO. : 4,300,353

DATED : Nov. 17, 1981

INVENTOR(S) : Ridgway, Stuart L.

It is certified that error appears in the above-identified patent and that said Letters Patent are hereby corrected as shown below:

receive steam from said steam generator and to generate mechanical power therefrom, said steam engine being operable to provide sufficient steady-state power to supplement said internal combustion engine adequately for most vehicle operating conditions, and said steam generator having sufficient heat capacity to act as an energy storage reservoir which may be drawn upon for short periods of vehicle acceleration; and means for mechanically coupling said internal combustion engine and said steam engine to propel the vehicle.--

Old claim 10, change claim number to -- 11 --; and in line 2 change "1" to -- 10 --.

Old Claim 11, change claim number to -- 12 --; and in line 2 change "10" to -- 11 --.

UNITED STATES PATENT AND TRADEMARK OFFICE

CERTIFICATE OF CORRECTION

PATENT NO. : 4,300,353

DATED : Nov. 17, 1981

INVENTOR(S) : Ridgway, Stuart L.

It is certified that error appears in the above-identified patent and that said Letters Patent are hereby corrected as shown below:

Old Claim 12, change claim number to -- 13 --; and in line 2 change "10" to -- 11 --.

Old Claim 13, change claim number to -- 14 --; and in line 2 change "10" to -- 11 --.

Old Claim 14, change claim number to -- 15 --; and in line 2 change "10" to -- 11 --.

Old Claim 15, change claim number to -- 16 --; and in line 2 change "14" to -- 15 --.

Old Claim 16, change claim number to -- 17 --; and AMEND as follows:

--17. A vehicle propulsion system as set forth in claim 10, and further comprising power control means for con-

UNITED STATES PATENT AND TRADEMARK OFFICE

CERTIFICATE OF CORRECTION

PATENT NO. : 4,300,353

DATED : Nov. 17, 1981

INVENTOR(S) : Ridgway, Stuart L.

It is certified that error appears in the above-identified patent and that said Letters Patent are hereby corrected as shown below:

trolling the rate of fuel-air mixture input to said internal combustion engine and the rate of steam input to said steam expander.--

Old Claim 17, change claim number to -- 18 --, and in line 2 change "16" to -- 17 --.

Old Claim 18, change claim number to -- 19 --, and in line 2 change "1" to -- 10 --.

Old Claim 19, change claim number to -- 20 --.

Old Claim 20, change claim number to -- 21 --, and in line 1 change "19" to -- 20 --.

Old Claim 21, change claim number to -- 22 --, and in line 1 change "19" to -- 20 --.

UNITED STATES PATENT AND TRADEMARK OFFICE

CERTIFICATE OF CORRECTION

PATENT NO. : 4,300,353

DATED : Nov. 17, 1981

INVENTOR(S) : Ridgway, Stuart L.

It is certified that error appears in the above-identified patent and that said Letters Patent are hereby corrected as shown below:

Old Claim 22, change claim number to -- 23 --; and in line 1 change "21" to -- 22 --.

Old Claim 23, change claim number to -- 24 --; and in line 1 change "19" to -- 20 --.

Old Claim 24, change claim number to -- 25 --; and in line 1 change "19" to -- 20 --.

Old Claim 25, change claim number to -- 26 --.

Old Claim 26, change claim number to -- 27 --; and in line 2 change "25" to -- 26 --.

Old Claim 27, change claim number to -- 28 --.

UNITED STATES PATENT AND TRADEMARK OFFICE

CERTIFICATE OF CORRECTION

PATENT NO. : 4,300,353

DATED : Nov. 17, 1981

INVENTOR(S) : Ridgway, Stuart L.

It is certified that error appears in the above-identified patent and that said Letters Patent are hereby corrected as shown below:

Old Claim 28, change claim number to -- 29 --; and in line 2 change "27" to -- 28 --.

Old Claim 29, change claim number to -- 30 --.

Signed and Sealed this

Sixth Day of April 1982

[SEAL]

Attest:

GERALD J. MOSSINGHOFF

Attesting Officer

Commissioner of Patents and Trademarks